US005697841A

United States Patent [19]

Di Giovine

[11] Patent Number: 5,697,841

[45] Date of Patent: Dec. 16, 1997

[54] AIR FLOW REGISTER

[76] Inventor: Carl Samuel Di Giovine, 367 Serpells Road, Doncaster East, Victoria, 3109, Australia

[21] Appl. No.: 669,852

[22] Filed: Jun. 26, 1996

Related U.S. Application Data

[63] Continuation of Ser. No. 524,692, Sep. 7, 1995, abandoned.

[30] Foreign Application Priority Data

Sep. 7, 1994 [AU] Australia ..... PM7920/94

[51] Int. Cl.[6] ..... F24F 13/075

[52] U.S. Cl. ..... 454/290; 454/286; 454/289; 454/307; 454/332

[58] Field of Search ..... 454/152, 155, 454/202, 284, 286, 289, 290, 306, 307, 309, 332

[56] References Cited

U.S. PATENT DOCUMENTS

| | | | |
|---|---|---|---|
| 1,691,285 | 11/1928 | Helms | 454/307 X |
| 1,921,305 | 4/1933 | Weisman . | |
| 2,759,411 | 8/1956 | Jenson . | |
| 3,225,679 | 12/1965 | Meyer . | |
| 3,264,971 | 8/1966 | Dangauthier . | |
| 3,736,858 | 6/1973 | Mercier | 454/286 |
| 3,921,507 | 11/1975 | Condet et al. | 454/155 |
| 4,610,196 | 9/1986 | Kern | 454/155 X |
| 4,633,770 | 1/1987 | Taylor et al. | 454/202 |
| 5,014,610 | 5/1991 | Twito . | |
| 5,188,561 | 2/1993 | Nissimoff et al. . | |
| 5,232,403 | 8/1993 | Marotta | 454/290 X |

FOREIGN PATENT DOCUMENTS

| | | |
|---|---|---|
| 558941 | 2/1987 | Australia . |
| 597549 | 5/1990 | Australia . |
| 647157 | 3/1994 | Australia . |

*Primary Examiner*—Harold Joyce

*Attorney, Agent, or Firm*—Knobbe, Martens, Olson & Bear, LLP

[57] ABSTRACT

An air flow register comprises a housing which is open at upper and lower ends and comprises a peripheral outwardly projecting flange at the upper end and a skirt portion which depends from the flange, the register further comprising a cowl which is pivotally mounted in the housing and which carries a plurality of spaced inclined air deflection vanes, the cowl being pivotable between a first position in which the cowl is raised to direct air from the register across a surface in which the register is located and a second position in which upper edges of the air deflector vanes extend substantially flush with the flange and in which the cowl abuts the housing skirt portion to close air flow through the cowl.

15 Claims, 6 Drawing Sheets

AIR FLOW REGISTER

This application is a continuation of U.S. patent application Ser. No. 08/524,692, filed Sep. 7, 1995 abandoned.

BACKGROUND OF THE INVENTION

The present invention relates to air flow registers and is particularly, but not essentially, concerned with an air flow register for use in a floor or other room surface for ducted air supply systems, whether for heating or cooling.

Floor-mounted air flow registers for central heating systems are commonly oblong in plan view and located adjacent a wall of the room with the longitudinal axis extending generally parallel to the wall. The registers direct air upwardly from the floor opening and usually have inclined air deflector vanes extending across the longitudinal axis so as to deflect the air longitudinally as well as upwardly over the wall surface.

It is sometimes desired to alternatively throw the air flow from the register towards the centre of the room, generally away from the wall, and, for example, in U.S. Pat. No. 3,225,679 it is proposed to provide a separate air deflector which sits over the register to perform this function. The deflector comprises a curved cowl to throw the air away from the wall and end walls to block passage of the air in the longitudinal direction. Since the air received beneath the cowl has already been deflected longitudinally by the air deflector vanes of the register, it is in a state of considerable turbulence so that the forward throw of the air tends to be negligible. Another disadvantage of the separate air deflector proposed in U.S. Pat. No. 3,225,679 is that when it is again desired to throw the air along the longitudinal axis of the register, the deflector must be removed and stored elsewhere.

U.S. Pat. No. 1,691,285 proposes a floor-mounted air flow register with a collapsible cowl which may be selectively raised to throw the air forwardly across the floor. Air deflector vanes are carried by the cowl so as to be flush with the floor when the cowl is lowered and raised with the cowl, but they extend parallel to the pivot axis of the cowl so as not to provide any longitudinal throw of the air parallel to that axis. A separate valve is provided to shut-off air flow to the register.

U.S. Pat. No. 1,921,305 also proposes a collapsible cowl, but in this case when the cowl is lowered it is used to shut-off air flow to the register. The cowl comprises a flexible rear wall which is curved when raised and substantially linear when lowered, with collapsible end walls and a complicated support mechanism to control the desired raising and lowering actions. Air deflector vanes are provided in this proposal, but are fixed in the register so are not raisable with the cowl.

Relatively simple raisable rigid air deflector cowls have been proposed for use in automobile air supply nozzles, for example in U.S. Pat. No. 3,264,971 and U.S. Pat. No. 4,610,196. In both of these, air deflector vanes are formed integrally with the cowl, but are shaped to throw the air forwardly from the front or upper face of the cowl, not substantially parallel to the cowl pivot axis. Furthermore, in U.S. Pat. No. 3,264,971 the cowl in its lowered position lies substantially flush with the support surface but cannot shut-off the air supply while in U.S. Pat. No. 4,610,196 the cowl can in one embodiment shut-off the air supply but cannot lie flush with the support surface in that condition.

SUMMARY OF THE INVENTION

According to the present invention there is provided an air flow register for controlling the flow of air from an air outlet in a surface, the register comprising a housing which is open at upper and lower ends and comprises a peripheral outwardly projecting flange at the upper end having an outermost lower edge which is substantially planar and is adapted to overlie the surface and a skirt portion which depends from an inner portion of the flange substantially perpendicular to the plane of said outermost lower edge and extends between the open upper and lower ends of the housing to define a passage therebetween, said skirt portion having a front wall, a back wall and spaced side walls extending between the front and back walls adapted to be received in said air outlet, said register further comprising a cowl which is pivotally mounted between the housing side walls about an axis extending parallel to said plane adjacent the front wall, said cowl having a curved rigid rear wall which is pivotally displaceable adjacent the housing back wall, end walls at opposite ends of the rear wall from which the cowl is pivoted and a plurality of spaced inclined air deflector vanes extending generally forwardly from adjacent an upper edge of the cowl rear wall between the end walls, the cowl being pivotable between a first position in which the cowl is raised to direct air from the register in a plane substantially parallel to said flange plane and a second position in which the air deflector vanes extend forwardly substantially parallel to said flange plane and have upper edges substantially flush with the flange and in which lower edges of the cowl rear wall and end walls about the housing front wall to close air flow through the cowl.

By the present invention, the cowl may be raised to the first position to throw air generally forwardly across the floor or other surface or lowered to the second position in which air flow through the register is closed with the upper edges of the air deflector vanes substantially flush with the flange so that the vanes can provide a support surface for people walking on the register. Stops are conveniently provided to define the first and second positions of the cowl.

The cowl is advantageously pivotable into one or more positions intermediate the first and second positions, preferably also defined by corresponding stops. Ion one such intermediate position, the cowl may be arranged to throw the air both forwardly and upwardly (from a floor-mounted register) for example at about 45°. The cowl is preferably pivoted through an angle of about 60° to 75° from the second position, more preferably about 65° to 70° and most preferably about 68°, to provide this air flow.

In another such intermediate position, the cowl may be pivoted to a position in which the rear wall of the cowl plays a negligible part in deflecting the air so that the air flow from the register is in a plane substantially normal to the flange plane. Thus, a floor-mounted register may allow the air to be directed generally upwardly with minimal, if any, forwards component if desired. For this purpose, the register is preferably pivoted to a position in the range about 40° to 60° from the second position, more preferably about 45° to 55° and most preferably about 50° from the second position.

One of the problems of providing an intermediate position of the cowl in which the air is not intended to be deflected substantially by the cowl rear wall when the rear wall is of such a length that its upper edge lies at least substantially flush with the housing flange in the second position while its lower edge abuts the housing front wall, is that turbulence induced by the rear wall lower edge may cause the air to deflect off the front wall of the housing and to create a backdraught. Advantageously, the cowl rear wall is arcuate and the arc extends through an angle in the range about 80° to 87° from the upper edge, preferably about 82° to 85°, more preferably about 84° from the upper edge, whereby turbulence caused by the lower edge of the cowl rear wall is reduced when the cowl is in said intermediate position. Thus, the cowl rear wall is effectively shortened to alleviate the turbulence.

The lower edge of each cowl end wall may be linear and angled to the upper edge thereof at said angle of the cowl rear wall arc, but in a preferred embodiment the upper edge and a major part of the lower edge of each end wall of the cowl extends substantially perpendicularly to each other with a portion of the lower edge of the end wall adjacent the lower edge of the rear wall being inclined to meet the lower edge of the rear wall and the front wall of the housing is correspondingly shaped whereby the lower edge of each end wall abuts the front wall of the housing along its full length in the second position of the cowl.

In considering the direction of air flow from the register of the invention as described above, the air deflector vanes should be disregarded. However, most advantageously, their principal intent is to spread the air directed through the register in a plane generally parallel to the cowl pivot axis. The air deflector vanes will generally be inclined in opposite directions from approximately the centre of the upper edge of the cowl rear wall, and the angle of inclination may be the same for all of the vanes. However, preferably, the angle of inclination increases with increasing distance from said central position so as to increase the spread of air in said plane. Even more preferably, the vanes are curved in cross-section so as to present relatively fine leading edges to the air and thereby reduce turbulence.

Advantageously, the air deflector vanes are formed separately to the rear and end walls of the cowl and are assembled therewith prior to use.

BRIEF DESCRIPTION OF THE DRAWINGS

One embodiment of an air flow register in accordance with the present invention will now be described by way of example only with reference to the accompanying drawings, in which.

Figure 1:
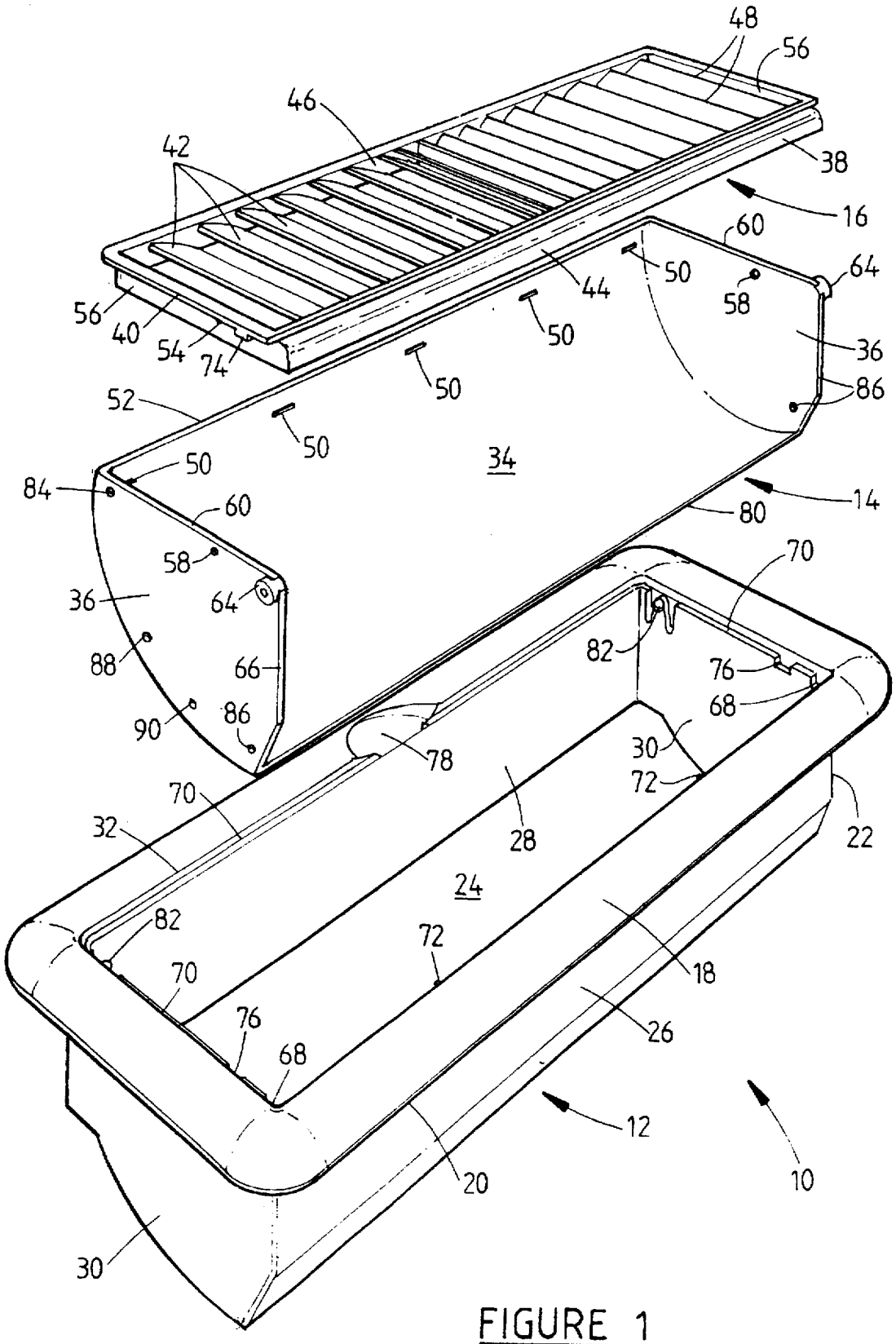
FIG. 1 is an exploded view of the register.

The air flow register 10 shown in non-limiting manner in the drawings comprises three components, a housing 12, a cowl body 14 and an air deflector vane device 16, each injection moulded in a suitable engineering plastics such as ABS and which are assembled prior to use. The cowl body 14 and device 16 together form a cowl of the register 10.

The housing 12 is open at its upper and lower ends and comprises a peripheral outwardly projecting flange 18 at the upper end having an outermost lower edge 20 which is planar. A skirt portion 22 depends from an inner part of the flange substantially perpendicular to the plane of the outermost lower edge 20 and extends between the open upper and lower ends of the housing to define an air flow passage 24 therebetween of oblong cross-section. The skirt portion has a front wall 26, a back wall 28 and spaced side walls 30 which extend between the front and back walls and are mirror images of each other.

The skirt portion 22 is adapted to be received in a corresponding opening in a floor of a room (not shown) with the lower edge 20 of the flange 18 resting on the floor so that an upper surface 32 of the flange is raised only slightly above floor level. Commonly, the floor will be carpeted and the flange will sink to a degree in the carpet.

An air supply boot of known type (not shown) will be closely fitted in use over the skirt portion 22 beneath the floor so as to direct air, usually heated, from a central source to the register. Space beneath the floor is often limited, and the skirt portion is made as short as possible while still providing a sufficient engagement surface for the boot that the boot and register 10 are not separated by the force of air passing through the boot to the register. In order to facilitate the relatively tight sliding fit of the boot onto the skirt portion 22 at least one wall, such as the front wall 26, may be inclined slightly inwardly relative to the perpendicular to the aforementioned plane, for example by about 1°.

The cowl body 14 comprises an arcuate rigid rear wall 34 and end walls 36 at opposite ends of the rear wall 34 which are mirror images of each other and substantially define sectors. The air deflector vane device 16 forms part of the air register cowl but is injection moulded separately from the cowl body 14 for ease of manufacture. The device 16 comprises an oblong frame 38 formed by a front member 44, a rear member 46 and side members 56. An outwardly projecting lip 40 extends along an upper edge of the rear and side members 46 and 56 and an array of spaced inclined air deflector vanes 42 extends between the front and rear members 44 and 46 of the frame 38 with upper edges 48 substantially flush with the lip 40 and with an upper edge of the front member.

The rear member 46 of the frame 38 of air deflector vane device 16 is provided with five outwardly projecting elongate lugs 49 (see FIG. 6) which are received in correspondingly shaped elongate openings 50 in the rear wall 34 of the cowl adjacent an upper edge 52 thereof. A rounded pin 54 (one only visible, in FIG. 1) projects outwardly from each side member 56 of the frame 38 and is received in a corresponding opening 58 in the respective end wall 36 of the cowl adjacent an upper edge 60 thereof by deflection of the end wall, to secure the air deflector vane device 16 on the cowl body 14. In this assembled condition, the lip 40 is seated on the upper edges 52 and 60 of the cowl rear and end walls and projects slightly beyond these walls. The lip 40 does not extend along the front member 44 of the frame 38. Instead, the front member 44 is of a double wall construction as shown in FIG. 6 with an outer skirt 62 of said double wall construction projecting forwardly relative to an inner wall member 63.

The cowl body 14 is provided with cylindrical stub axles 64 projecting axially outwardly from respective end walls 36 at the junction of the upper edge 60 and a lower edge 66 of each. The axles 64 are snap-engagingly or otherwise securely received in cooperating slots 68 in the side walls 30 of the housing skirt portion 22. The slots 68 are provided adjacent the front wall 26 of the housing skirt portion and adjacent the housing flange 18 to define a cowl pivot axis extending parallel to the plane of the lower edge 20 of the housing flange. The flange 18 is stepped outwardly from the housing skirt portion back and side walls 28 and 30, respectively, to define a shoulder 70 on which the outwardly projecting portion of the lip 40 of the air deflector vane device 16 sits when the cowl is in its lowered position shown in FIGS. 2, 4 and 6c. In this position, the skirt 62 of the frame 38 lies closely adjacent the front wall 26 of the housing 10 and is seated on the top end of front wall ribs 72, as shown in FIG. 6c. Also in this position, locating lugs 74 depending from the portions of the lip 40 projecting outwardly from the side members 56 of the frame 38 are received in corresponding slots 76 in the shoulder 70 of each housing side wall 30. Furthermore, a recess 78 is formed in the housing flange 18 centrally of the rear wall 28 to enable a finger to be placed under a corresponding portion of the lip 40 projecting outwardly from the rear frame member 46 of the air deflector vane device 16 to facilitate raising the cowl out of its lowered position.

The cowl body 14 is sized to be a close fit in the housing upper end so that the cowl rear wall 34 is pivotally displaceable closely adjacent to the housing back wall 28 as shown in FIG. 6 and the cowl end walls 36 are pivotally displaceable closely adjacent to the housing side walls 30, whereby air flow other than through the cowl is minimised. Also as shown in FIG. 6, the skirt 62 of the front member 44 of the air deflector vane device 16 substantially maintains contact with the front wall 26 of the housing during the pivotal movement of the cowl so as to minimise air flow between the skirt 62 and the housing front wall 26.

Figure 2:
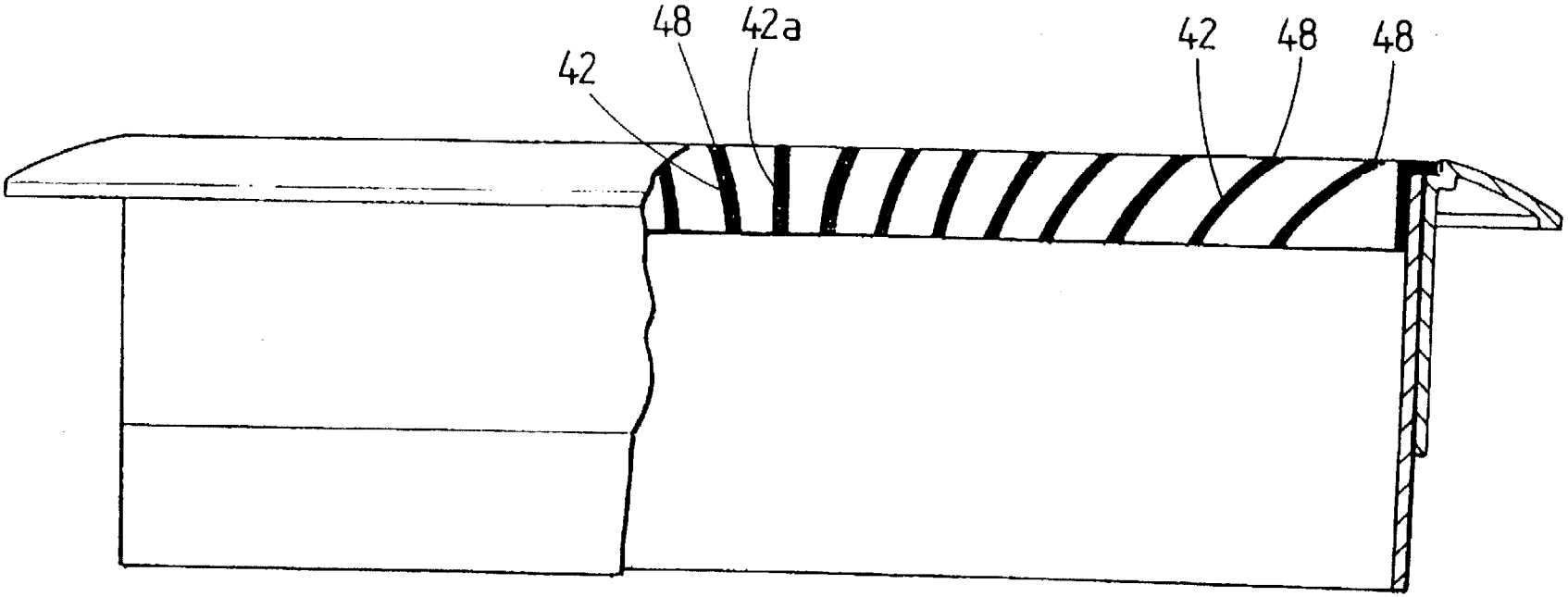
FIG. 2 is a part sectional front elevational view of the assembled register showing the air deflector vanes.
Figure 4:
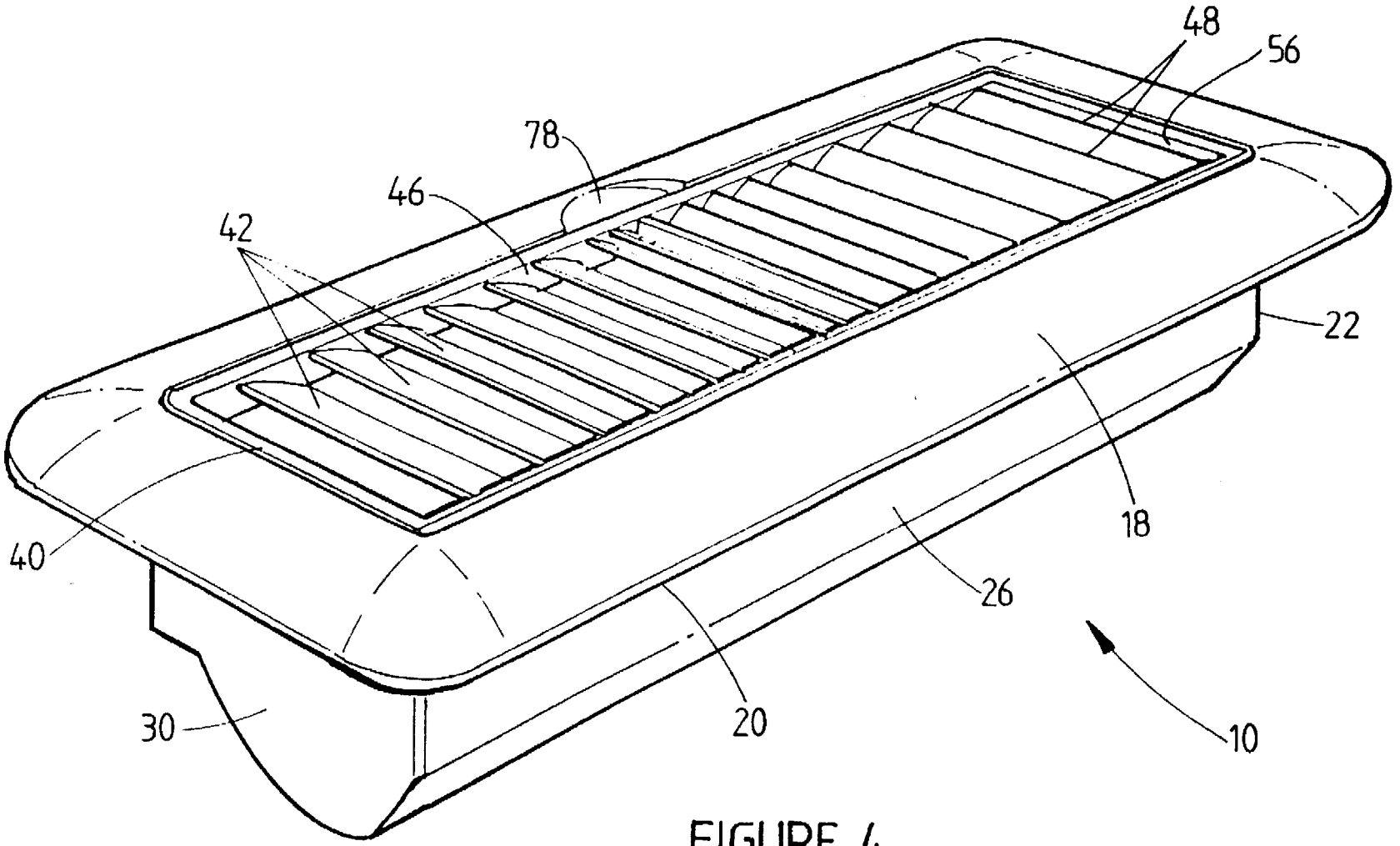
FIG. 4 is a view similar to FIG. 3 but showing the cowl in a second lowered position.

In the lowered position of the cowl as shown in FIGS. 2, 4 and 6c, the lower edge 66 of each cowl end wall 36 and a lower edge 80 of the cowl rear wall 34 extending between the end wall lower edges 66 abut the front wall of the housing along their full length to close off air flow through the register 10 (see FIG. 6c). The close fit of the components of the register minimises leakage, and possible whistling, from the register in its closed position.

The pressure of air from the central supply on the convex surface of the rear wall 34 of the cowl will tend to bias the cowl out of its closed position. In order to resist this, resiliently mounted rounded engagement pins 82 project inwardly from the side walls 30 of the housing 12 remote from the axle mounting slots 68 and adjacent the shoulder 70 to engage corresponding recesses 84 (one only shown) in the outer face of the cowl end walls 36.

Figure 3:
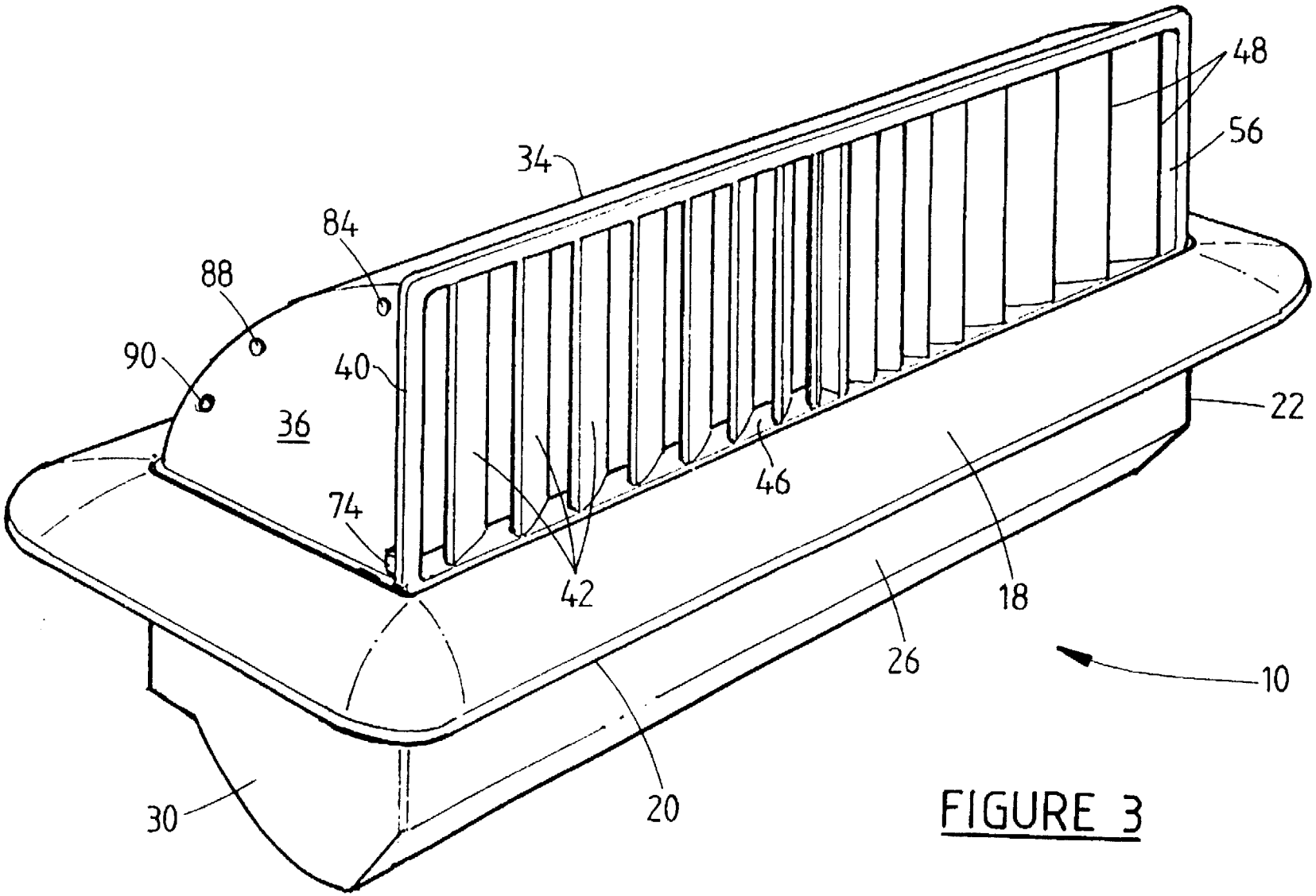
FIG. 3 is a perspective view showing an air deflection cowl in a first raised position.
Figure 6A:
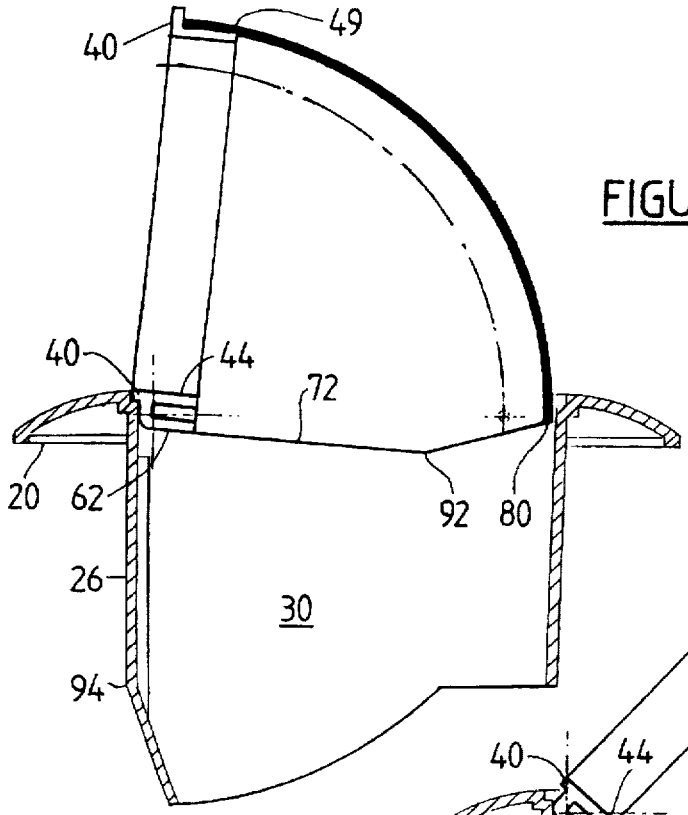
FIGS. 6*a*, *b* and *c* show cross-sectional views with the cowl in the positions of FIGS. 3 to 5 respectively, but seen from the opposite end to the views of FIGS. 3 to 5.

Corresponding recesses 86 are provided to hold the cowl in the fully raised position shown in FIGS. 3 and 6a in which air is directed from the register in a plane substantially parallel to the plane of the lower edge 20 of housing flange 18, and therefore generally across the floor.

Figure 5:
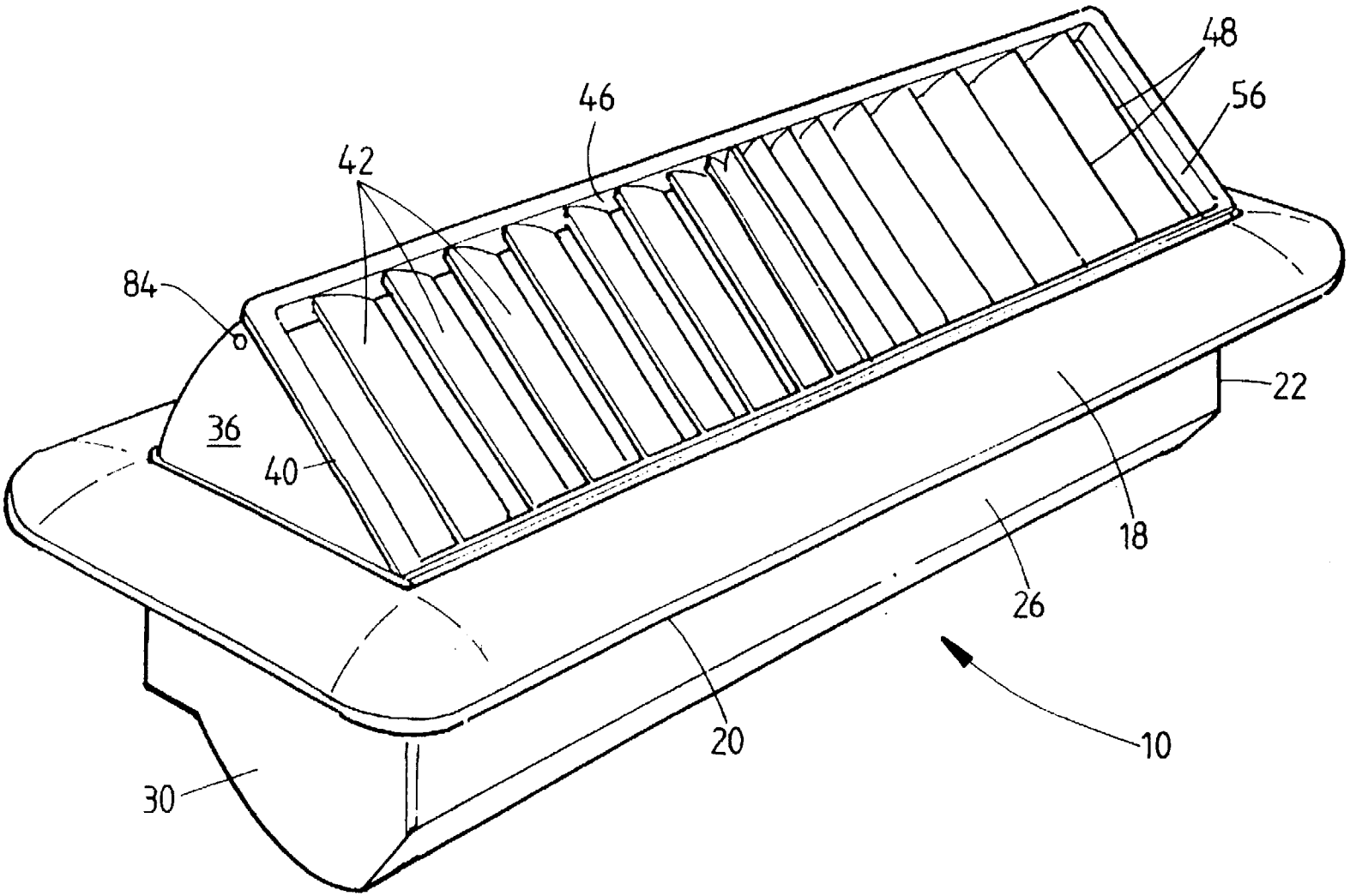
FIG. 5 is a view similar to FIGS. 3 and 4 but showing the cowl in an intermediate position.
Figure 6B:
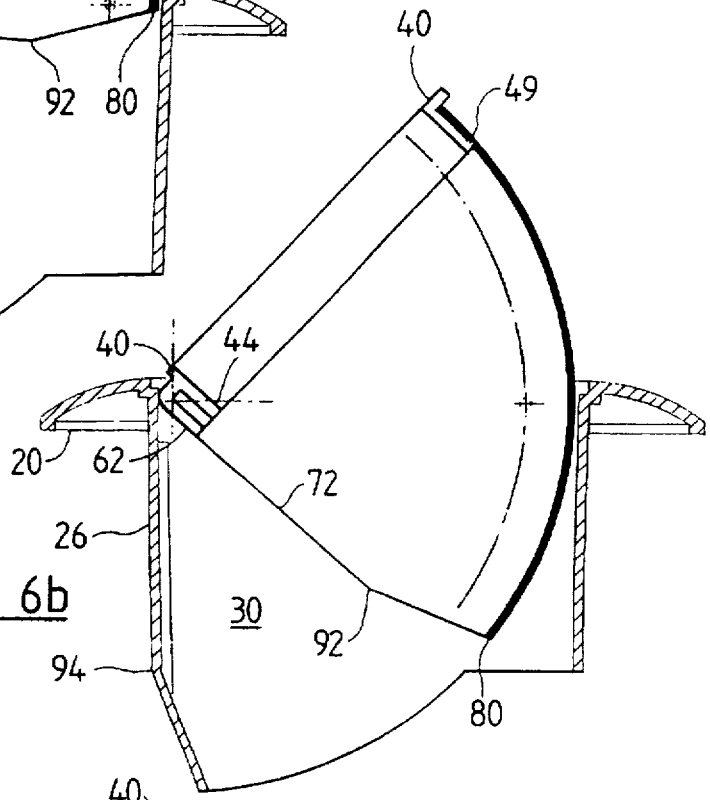
Figure 6C:
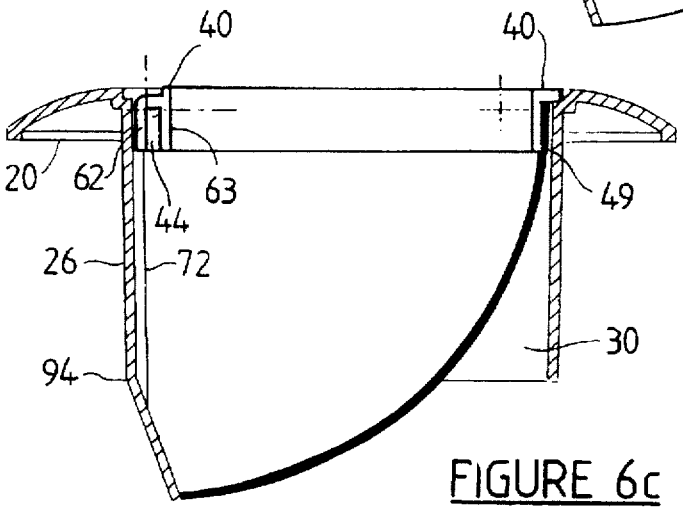

Corresponding openings 88 and 90 are also provided to hold the cowl in intermediate positions in which they have been pivoted through 50° and 68° respectively from the lowered position. At 68° the air is directed in a plane both upwardly and forwardly at about 45° to the plane of the lower edge 20 of the housing flange 18, while at 50° substantially all of the air is directed upwardly substantially perpendicular to the plane of the lower edge 20 of the housing flange 18. This latter position is illustrated in FIGS. 5 and 6b. From FIG. 6 as well as from FIG. 1, it may be seen that the upper edge 60 and a major portion of the lower edge 66 of the cowl end walls 36 extend substantially perpendicularly to each other. However, it is found that if the cowl rear wall 34 extends through a full 90° arc, considerable turbulence may be caused by the lower edge 80 of the cowl rear wall when the cowl is in its intermediate position at 50° from the lowered position. This turbulence tends to cause the air to be deflected onto and then off the front wall of the housing causing a backdraught. That is, the air deflected off the housing front wall 26 tends to pass in a rearwards direction through and beyond the air deflector vane device 16. In order to alleviate this turbulence and resultant backdraught in this intermediate position, the arcuate extend of the cowl rear wall 34 is reduced to about 84° from the cowl upper edge 52. Since the lower edges 66 and 80 of the cowl end and rear walls must still abut the housing front wall 26 in the lowered closed position and the housing front wall must depend substantially perpendicularly from the flange over at least a substantial part of its length in order to properly receive the aforementioned air distribution boot, the lower edges 66 of the cowl end walls 36 are kinked through an angle of about 20° at 92 near the lower edge 80 of the cowl rear wall so as to meet the lower edge 80, and the housing front wall 26 is correspondingly kinked at 94. The housing back wall 28 is shorter than the front wall 26, and the housing side walls 30 are shaped to closely overlie the full extend of the cowl end walls 36 in the lowered position of the cowl.

The air deflector vanes 42 are inclined in opposite directions from a central vane 42a clearly shown in FIG. 2. The angle of inclination of the vanes increases with increasing distance from the central vane 42a so as to enlarge the arc through which the vanes deflect the air substantially in a plane parallel to the cowl pivot axis. The vanes are short and the inclined vanes curved so as to reduce turbulence caused by the vanes. As clearly seen in FIG. 2, the upper edges 48 of the vanes are substantially flush with the upper edge 32 of the housing flange 18 so as to facilitate walking over the air flow register. Since the cowl rear and end walls are closed and the cowl is a close fit in the housing 12, substantially all of the air which enters the housing lower end from the air distribution boot is directed out between the vanes 42 when the cowl is not in the lowered closed position.

Those skilled in the art will appreciate that the invention described herein is susceptible to variations and modifications other than those specifically described. It is to be understood that the invention includes all such variations and modifications which fall within the its spirit and scope. The invention also includes all of the steps and features referred to or indicated in this specification, individually or collectively, and any and all combinations of any two or more of said steps or features.

I claim:

1. An air flow register for controlling the flow of air from an air outlet in a surface, the register comprising a housing which is open at upper and lower ends and comprises a peripheral outwardly projecting flange at the upper end having an outermost lower edge which is substantially planar and is adapted to overlie the surface and a skirt portion which depends from an inner portion of the flange substantially perpendicular to the plane of said outermost lower edge and extends between the open upper and lower ends of the housing to define a passage therebetween, said skirt portion having a front wall, a back wall and spaced side walls extending between the front and back walls adapted to be received in said air outlet, said register further comprising a cowl which is pivotally mounted between the housing side walls about an axis extending parallel to said plane adjacent the front wall, said cowl having an curved rigid rear wall which is pivotally displaceable adjacent the housing back wall, end walls at opposite ends of the rear wall from which the cowl is pivoted and a plurality of spaced inclined air deflection vanes extending generally forwardly from adjacent an upper edge of the cowl rear wall between the end walls, the cowl being pivotable between a first position in which the cowl is raised to direct air from the register in a plane substantially parallel to said flange plane and a second position in which the air deflector vanes extend forwardly substantially parallel to said flange plane and have upper edges substantially flush with the flange and in which lower edges of the cowl rear wall and end walls abut the housing front wall to close air flow through the cowl.

2. An air flow register according to claim 1 wherein the cowl rear wall is arcuate.

3. An air flow register according to claim 2 wherein the arc of the cowl rear wall extends through an angle in the range of about 80° to 87°.

4. An air flow register according to claim 3 wherein said angle is in the range of about 82° to 85°.

5. An air flow register according to claim 4 wherein said angle is about 84°.

6. An air flow register according to claim 1 wherein the cowl is capable of being positioned in an intermediate position between the first and second positions in which the cowl is pivoted through an angle in the range of about 60° to 75° from the second position.

7. An air flow register according to claim 6 wherein said angle is in the range of about 65° to 70° from the second position.

8. An air flow register according to claim 7 wherein said angle is about 68° from the second position.

9. An air flow register according to claim 1 wherein the cowl is capable of being positioned in an intermediate position between the first and second positions in which the cowl is pivoted through an angle in the range of about 40° to 60° from the second position.

10. An air flow register according to claim 9 wherein said angle is in the range of about 45° to 55° from the second position.

11. An air flow register according to claim 10 wherein said angle is about 50° from the second position.

12. An air flow register according to claim 3 wherein the upper edge and a major part of the lower edge of each end wall of the cowl extends substantially perpendicularly to each other with a portion of the lower edge of the end wall adjacent the lower edge of the rear wall being inclined to meet the lower edge of the rear wall and the front wall of the housing is correpsondingly shaped whereby the lower edge of each end wall abuts the front wall of the housing along its full length in the second position of the cowl.

13. An air flow register according to claim 1 wherein the air deflector vanes are inclined in opposite directions from approximately the centre of the upper edge of the cowl rear wall and wherein the angle of inclination increases with increasing distance of the vanes from said central position.

14. An air flow register according to claim 13 wherein the vanes are curved upwardly and outwardly in cross-section.

15. An air flow register according to claim 1 wherein the air deflector vanes are assembled with a cowl body comprising the rear and end walls of the cowl.

* * * * *

UNITED STATES PATENT AND TRADEMARK OFFICE
CERTIFICATE OF CORRECTION

PATENT NO. : 5,697,841

DATED : December 16, 1997

INVENTOR(S) : Carl Samuel Di Giovine

It is certified that error appears in the above-identified patent and that said Letters Patent is hereby corrected as shown below:

On the abstract page, insert the name and address of the assignee as follows --Ventec Pty. Ltd., Victoria, Australia--.

Signed and Sealed this

Twenty-third Day of March, 1999

*Attest:*

Q. TODD DICKINSON

*Attesting Officer*

*Acting Commissioner of Patents and Trademarks*